US007246659B2

(12) United States Patent
Fripp et al.

(10) Patent No.: US 7,246,659 B2
(45) Date of Patent: Jul. 24, 2007

(54) DAMPING FLUID PRESSURE WAVES IN A SUBTERRANEAN WELL

(75) Inventors: Michael L. Fripp, Carrollton, TX (US); Adam Wright, Dallas, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 436 days.

(21) Appl. No.: 10/377,335

(22) Filed: Feb. 28, 2003

(65) Prior Publication Data

US 2004/0168805 A1 Sep. 2, 2004

(51) Int. Cl.
*E21B 43/117* (2006.01)

(52) U.S. Cl. ..... 166/55.1; 166/297; 175/4.54; 175/4.56

(58) Field of Classification Search ..... 166/297, 166/55.1; 175/4.56, 4.54; 102/312–313; 299/13

See application file for complete search history.

(56) References Cited

U.S. PATENT DOCUMENTS 2,139,104 A * 12/1938 Wells ..... 175/4.54
2,486,133 A * 10/1949 Egger ..... 138/41
2,797,892 A * 7/1957 Ryan ..... 175/4.56
3,709,294 A * 1/1973 Kilgore ..... 166/243
3,923,105 A * 12/1975 Lands, Jr. ..... 175/4.55
4,226,475 A * 10/1980 Frosch et al. ..... 299/13
4,694,878 A * 9/1987 Gambertoglio ..... 166/377
4,760,883 A * 8/1988 Dunn ..... 166/297
4,817,710 A * 4/1989 Edwards et al. ..... 166/242.7
5,088,557 A * 2/1992 Ricles et al. ..... 166/297
5,117,911 A * 6/1992 Navarette et al. ..... 166/299
6,332,401 B1 * 12/2001 Tota et al. ..... 102/303
6,554,081 B1 * 4/2003 Brooks et al. ..... 175/4.54
2002/0020535 A1 * 2/2002 Johnson et al. ..... 166/363

* cited by examiner

*Primary Examiner*—Jennifer H. Gay
*Assistant Examiner*—Giovanna M Collins
(74) *Attorney, Agent, or Firm*—Smith IP Services, P.C.

(57) ABSTRACT

A system and method of damping fluid pressure waves in a subterranean well. In a described embodiment, pressure waves are damped by positioning a dampener in the well during a perforating operation. The dampener may attenuate the pressure waves by absorbing the pressure waves, flowing the pressure waves through viscously damping material, generating complementary pressure waves, changing a material phase, or by a combination of these methods.

30 Claims, 5 Drawing Sheets

DAMPING FLUID PRESSURE WAVES IN A SUBTERRANEAN WELL

BACKGROUND

The present invention relates generally to equipment utilized and operations performed in conjunction with a subterranean well and, in an embodiment described herein, more particularly provides a system and method for damping fluid pressure waves in a subterranean well.

It is well known that detonation of perforating guns in a well can cause damage to equipment in the well. It has generally been considered that this damage is due primarily to forces generated by detonation of the perforating guns. These forces are transmitted to other equipment via a tubing string in which the perforating guns and the other equipment are interconnected.

For this reason, previous attempts to protect the equipment from damage have focused on isolating the equipment from the forces generated by the perforating guns' detonation. For example, shock absorbers have been interconnected in the tubing string between the equipment and the perforating guns. As another example, methods have been developed wherein the equipment is physically separated from the perforating guns prior to detonating the perforating guns.

However, damage to equipment may actually, or additionally, be caused by pressure waves generated by the perforating guns when they are detonated. Shock absorbers do not isolate the equipment from damage due to these pressure waves. Furthermore, separating the equipment from the perforating guns may not be necessary if damage to the equipment may be prevented, or at least substantially reduced, by damping the pressure waves.

Damping pressure waves may also be beneficial in other operations performed in wells. For example, fracturing operations, propellant-driven packer setting, casing repair, etc.

SUMMARY

In carrying out the principles of the present invention, in accordance with embodiments thereof, a system and method of damping fluid pressure waves in a subterranean well is provided. In a described embodiment, pressure waves are damped by positioning a dampener in the well during a perforating operation. The dampener may attenuate the pressure waves by absorbing the pressure waves, flowing the pressure waves through viscously damping material, generating complementary pressure waves, changing a material phase, or by a combination of these methods.

In one aspect of the invention, a perforating system for a subterranean well is provided. The system includes a perforating gun positioned in the well, and a fluid pressure wave dampener positioned in the well, The dampener damps pressure waves generated by detonation of the perforating gun.

In another aspect of the invention, a method of damping pressure waves in a subterranean well is provided. The method includes the steps of: providing a fluid pressure wave dampener; positioning the dampener in the well; generating the pressure waves in the well; and damping the pressure waves with the dampener.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
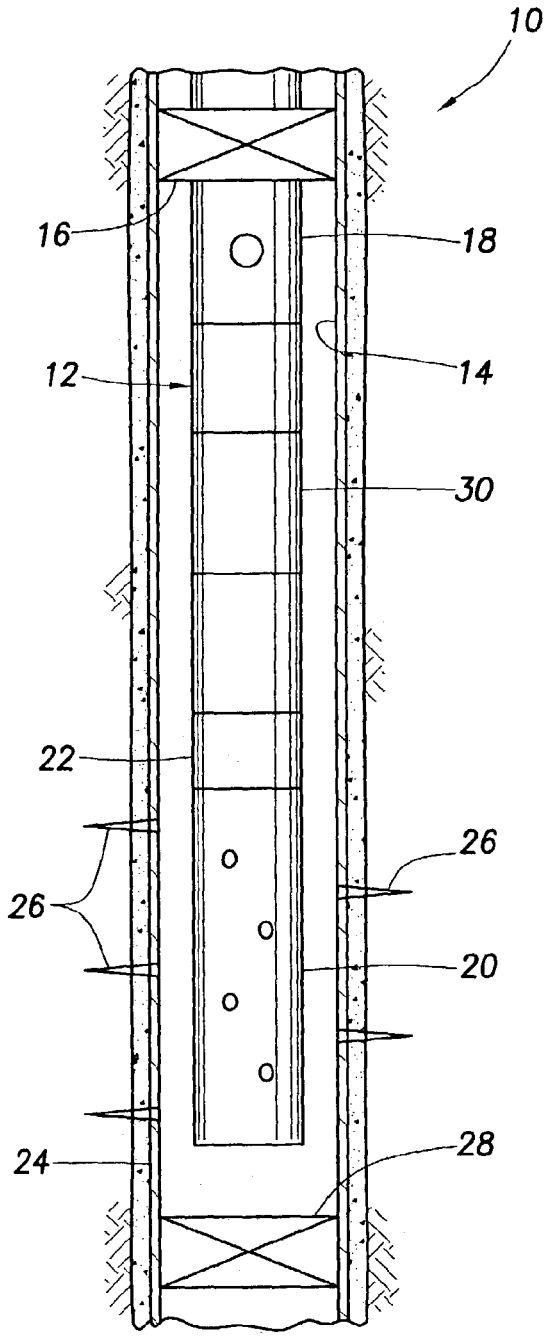
FIG. 1 is a schematic cross-sectional view of a first method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, a tubing string 12 is conveyed into a wellbore 14. The tubing string 12 includes a packer 16, a production valve 18, a perforating gun 20 and a firing head 22. The packer 16 is set in casing 24 lining the wellbore 14, and the perforating gun 20 is detonated to form perforations 26 extending outwardly through the casing.

A bridge plug or sump packer 28 may be set in the casing 24 below the perforating gun 20 prior to, or in conjunction with, running the tubing string 12 into the well. Alternatively, the wellbore 14 below the perforating gun 20 may be open to the casing shoe (not shown) or the bottom of the well.

Any number of perforating guns, firing heads, etc. may be used in the method 10 in keeping with the principles of the invention. It should also be clearly understood that, although the method 10 as described herein is a method wherein a perforating operation is performed, the principles of the invention are not limited to any particular details of the method described herein, and are not limited to perforating operations at all. The principles of the invention have application in any operation wherein it is desired to dampen pressure waves in a well, for example, formation fracturing operations, casing repair operations, packer setting, etc., each of which may generate damaging pressure waves in the well.

It has been found that pressure waves generated by detonation of a perforating gun, such as the perforating gun 20, travel through fluid in the well and create pressure differentials across equipment in the well. For example, a pressure wave generated at the perforating gun 20 will travel both upward and downward in the wellbore 14. Upwardly traveling pressure waves will reflect off of the packer 16 and begin to travel downward. Downwardly traveling pressure waves will reflect off of the plug 28, or the bottom of the well, and begin to travel upward.

Where coinciding in-phase, or approximately in-phase, pressure waves are at their maximum pressure amplitude, a relatively high pressure is experienced by the tubing string 12. This condition is believed to occur typically just below the packer 16, at the top end of the perforating gun 20, and just above the plug 28 or bottom of the well.

Where coinciding in-phase, or approximately in-phase, pressure waves are at their minimum pressure amplitude, a relatively low pressure is experienced by the tubing string 12. This condition is believed to occur typically one-fourth wavelength above the plug 28 or bottom of the well, one-fourth of the distance from the top end of the guns to the plug or bottom of the well, and one-fourth of the distance from the packer to the plug or bottom of the well.

When the relatively high and low pressures are applied to the tubing string 12, the differential between the high and low pressures produces very high stresses in the tubing string, leading to significant damage to the equipment interconnected therein. Therefore, in the method 10, a pressure wave dampener 30 is interconnected in the tubing string 12. The dampener 30 acts to reduce the amplitude of the pressure waves generated in the well, thereby decreasing the pressure differential produced across the tubing string 12.

The dampener 30 may operate by absorbing or viscously damping the pressure waves, or by generating a resonant frequency which complements that of the pressure waves in the well. If the dampener 30 operates by absorbing or viscously damping the pressure waves, it should preferably be positioned at one or more locations where the highest fluid velocity is found, which is where the pressure wave amplitude is at its minimum, as described above. If the dampener 30 operates by generating complementary pressure waves, it should preferably be positioned at one or more locations where the lowest fluid velocity is found, which is where the pressure wave amplitude is at its maximum, as described above.

Figure 2:
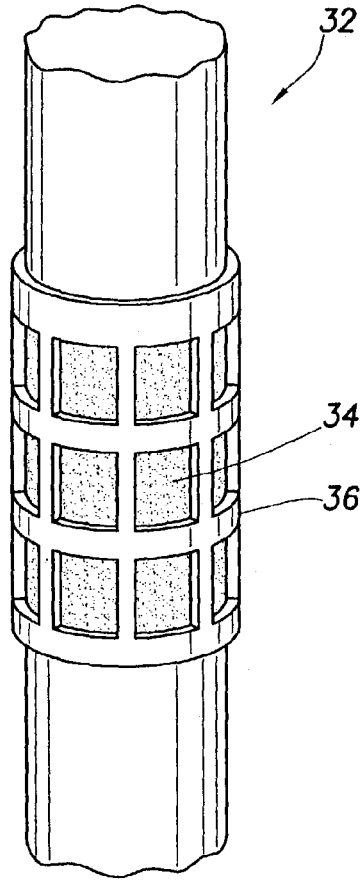
FIG. 2 is a perspective view of a first pressure wave dampener embodying principles of the invention.

Referring additionally now to FIG. 2, a pressure wave dampener 32 is representatively illustrated. The dampener 32 may be used for the dampener 30 in the method 10. However, it should be understood that the dampener 32 may be used in other methods, without departing from the principles of the invention.

The dampener 32 includes a pressure wave absorbent material 34 enclosed in a protective outer cage 36. The pressure wave absorbent material 34 is preferably a porous or fibrous material, such as steel wool, mineral wool, open-cell foam, etc. The material 34 viscously dampens pressure waves by forcing the fluid to flow through its many small passages in order to transmit pressure therethrough.

Figure 3:
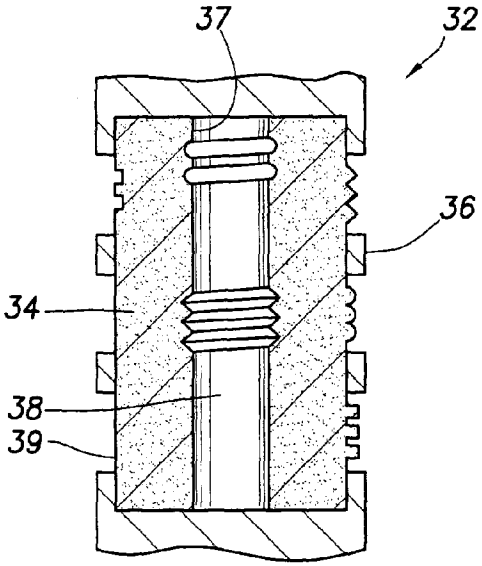
FIG. 3 is a schematic cross-sectional view of the first pressure wave dampener.

Referring additionally now to FIG. 3, a cross-sectional view of the dampener 32 is representatively illustrated. In this view it may be seen that a hollow cavity 38 is formed within the material 34. The cavity 38 is hollow in that it has none of the material 34 therein. The size (height, diameter, volume, etc.), shape and position of the cavity 38 may be adjusted as desired to "tune" the dampener 32 so that it attenuates a particular pressure wave frequency. For example, it may be found through experimentation or practical observation that a particular frequency band causes a substantial portion of damage to the tubular string 12. In that case, the size of the cavity 38, or other parts of the dampener 32, may be adjusted to target that frequency band.

Note that interior and exterior surfaces 37, 39 of the material 34 may be smooth, and/or may be provided with scallops, crenellations, fingers, peaks and valleys, other recesses, other projections etc., as depicted in FIG. 3. These various surfaces may be used to target a particular pressure wave frequency and/or increase the overall attenuation provided by the dampener 32.

Figure 4:
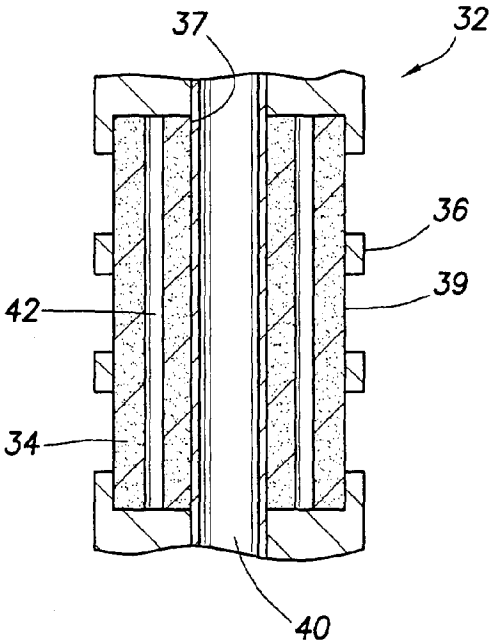
FIG. 4 is a schematic cross-sectional view of a first alternate construction of the first pressure wave dampener.

Referring additionally now to FIG. 4, another alternate construction of the dampener 32 is representatively illustrated. In this construction, a flow passage 40 of the tubing string 12 extends axially through the dampener 32. The material 34 is isolated from the flow passage 40. This construction enables production flow, equipment, circulation, etc., to pass through the dampener 32.

An annular cavity 42 may be provided in the material 34. As with the cavity 38 described above, the size, shape and position of this cavity 42 may be adjusted as desired to target a particular frequency band for damping. As with the construction depicted in FIG. 3, the interior and/or exterior surfaces 37, 39 of the material 34 may be smooth, and/or may be provided with scallops, crenellations, fingers, peaks and valleys, recesses, projections, etc.

Figure 5:
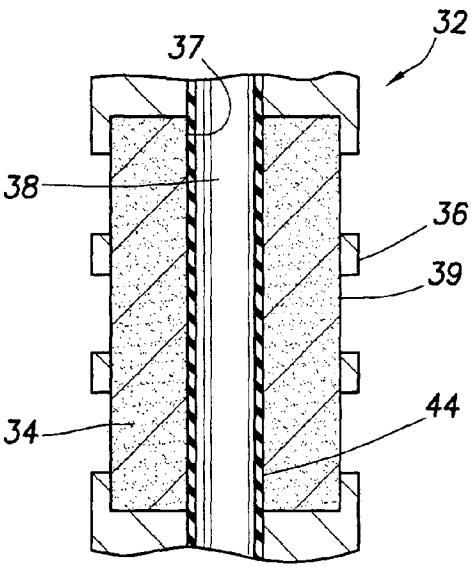
FIG. 5 is a schematic cross-sectional view of a second alternate construction of the first pressure wave dampener.

Referring additionally now to FIG. 5, another alternate construction of the dampener 32 is representatively illustrated. In this alternate construction, the material 34 is isolated from the cavity 38 by a flexible impermeable membrane 44. The membrane 44 could, for example, be made of an elastomer material, such as rubber, nitrile, viton, etc., or it could be made of a non-elastomer.

Preferably, the cavity 38 is filled with a liquid, such as silicone oil, etc. Alternatively, the cavity 38 could be in fluid communication with the wellbore 14 external to the dampener 32, so that well fluid is in the cavity. Thus, the cavity 38 could be pressure balanced with the wellbore 14 surrounding the dampener 32. Again, the size, shape and position of the cavity 38 may be adjusted to target a particular pressure wave frequency band. As with the construction depicted in FIG. 3, the interior and/or exterior surfaces 37, 39 of the material 34 may be smooth, and/or may be provided with scallops, crenellations, fingers, peaks and valleys, recesses, projections, etc.

Figure 6:
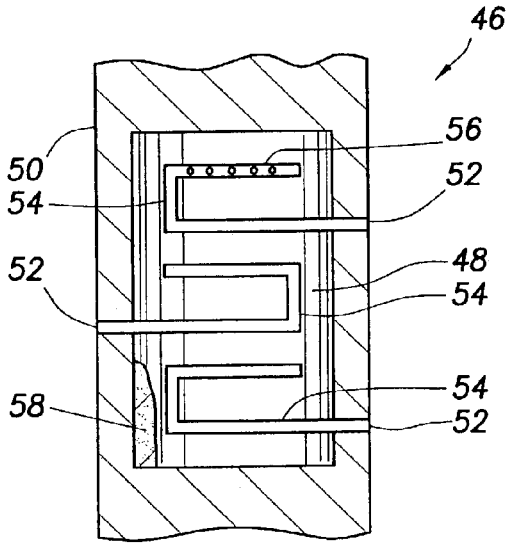
FIG. 6 is a schematic cross-sectional view of a second pressure wave dampener embodying principles of the invention.

Referring additionally now to FIG. 6, another pressure wave dampener 46 is representatively illustrated. The dampener 46 may be used for the dampener 30 in the method 10. However, it should be understood that the dampener 46 may be used in other methods, without departing from the principles of the invention.

The dampener 46 includes an enclosed volume 48 within a housing 50 having multiple openings 52 through a sidewall thereof. Flowpaths 54 provide fluid communication between the volume 48 and the openings 52. When the dampener 46 is positioned in a well, such as that depicted in FIG. 1, the openings 52 and flowpaths 54 provide fluid communication between the volume 48 and the wellbore 14 external to the dampener.

The dampener 46 is similar in many respects to a device known to those skilled in the acoustic damping art as a Helmholtz resonator. A Helmholtz resonator cancels sound waves by generating sound waves out of phase. The sound waves enter the resonator openings, travel through the flowpaths to the volume, and are reflected back out of phase.

The Helmholtz resonator is particularly useful in targeting a relatively narrow frequency band of sound waves at which it resonates. The approximate resonant frequency of a Helmholtz resonator is given by the following formula: $f = c/2\pi (A/LV)^{1/2}$, in which c is the speed of sound, A is the area of the openings, L is the length of the flowpaths and V is the internal volume. It is believed that the same formula would approximate the resonant frequency of the dampener 46 depicted in FIG. 6.

Several modifications may be made to the dampener 46 to increase the frequency band at which it is effective to dampen the pressure waves. For example, the flowpaths 54 may be perforated as shown at 56 to thereby provide multiple flowpath lengths between the openings 52 and the volume 48, and to add viscous damping. As another example, a pressure wave absorbent material 58 may be positioned in the volume 48 to add viscous damping.

Figure 7:
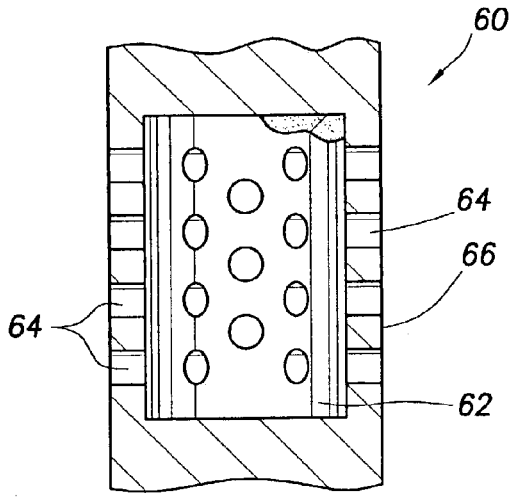
FIG. 7 is a schematic cross-sectional view of a third pressure wave dampener embodying principles of the invention.

Referring additionally now to FIG. 7, another pressure wave dampener 60 is representatively illustrated. The dampener 60 may be used for the dampener 30 in the method 10. However, it should be understood that the dampener 60 may be used in other methods, without departing from the principles of the invention.

The dampener 60 is somewhat similar to the dampener 46 described above, in that it includes an internal chamber 62 and multiple openings 64 providing fluid communication between the internal chamber and the well exterior to the dampener. The openings 64 are formed through a sidewall 66 separating the chamber 62 from the well exterior to the dampener 60. However, the dampener 60 does not have elongated flowpaths between the openings 64 and the chamber 62.

Preferably, the openings 64 have a combined area which is approximately 30% to 60% of the surface area of the sidewall 66. This configuration uses viscous damping of the pressure waves traveling through the sidewall 66 to damp the pressure waves. By adjusting the size, shape, number and positioning of the openings 64, and the size and shape of the chamber 62, the frequency band at which maximum pressure wave attenuation is achieved may be altered as desired. In addition, pressure wave absorbent material 68 may be positioned in the chamber 62.

Figure 8:
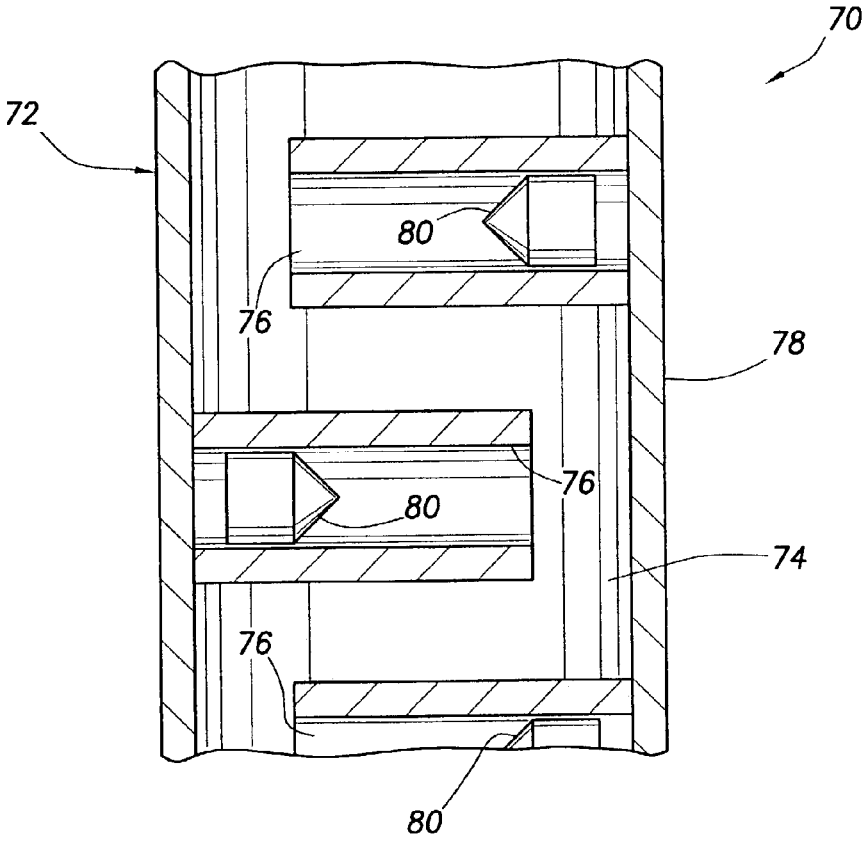
FIG. 8 is a schematic cross-sectional view of a fourth pressure wave dampener embodying principles of the invention.

Referring additionally now to FIG. 8, another pressure wave dampener 70 is representatively illustrated. The dampener 70 may be used for the dampener 30 in the method 10, except that the dampener 70 is combined with a perforating gun 72. Of course, the dampener 70 may be used in other methods, without departing from the principles of the invention.

An internal volume 74 is formed in the gun 72. Flowpaths 76 extend into the volume 74 from a sidewall 78 of the gun 72. It will be readily appreciated that, when the gun 72 is detonated, openings (not shown) will be formed by perforators 80 (explosive shaped charges) through the sidewall 78. At that point, the gun 72 will be very similar to the dampener 46 depicted in FIG. 6, in that the openings and flowpaths 76 will provide fluid communication between the volume 74 and the wellbore external to the dampener 70.

Figure 9:
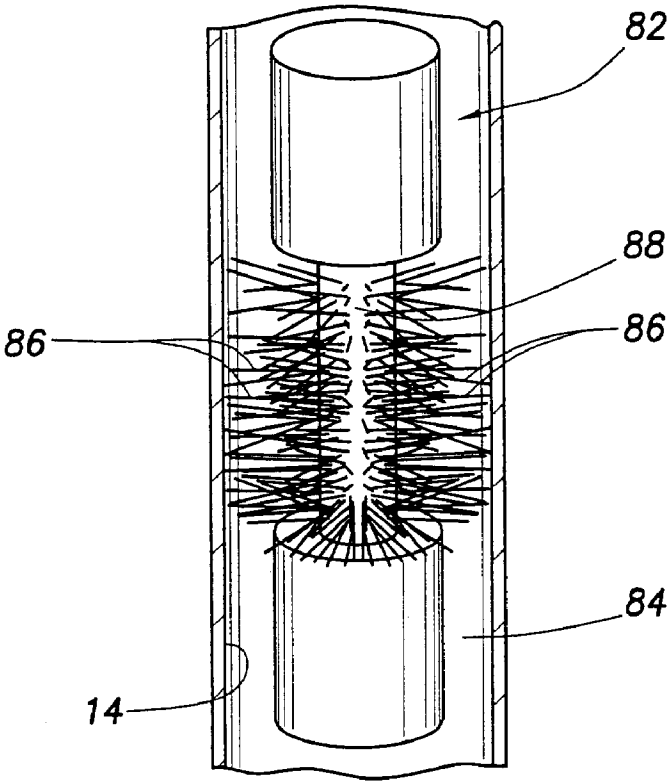
FIG. 9 is a perspective view of a fifth pressure wave dampener embodying principles of the invention.

Referring additionally now to FIG. 9, another pressure wave dampener 82 is representatively illustrated. The dampener 82 may be used for the dampener 30 in the method 10. However, it should be understood that the dampener 82 may be used in other methods, without departing from the principles of the invention.

The dampener 82 acts by viscously damping the pressure waves traveling through an annulus 84 formed between the wellbore 14 and the tubing string 12. The dampener 82 includes whiskers or fibers 86 extending outwardly from a central axially extending mandrel 88. Preferably, the fibers 86 contact the wellbore 14, in which case the fibers may be deployed after the dampener 82 is conveyed into the well, for example, by removing a shroud (not shown) initially constraining the fibers. Removal of the shroud enables the fibers 86 to extend outward into contact with the wellbore 14.

The fibers 86 may be made of any material, including steel, other metals, plastics, composites, etc. The fibers 86 may be made of a phase change alloy, in which case the pressure waves traveling through the fibers induce strain in the fibers, which causes the fibers to change phase and thereby absorb increased energy from the pressure waves.

Figure 10:
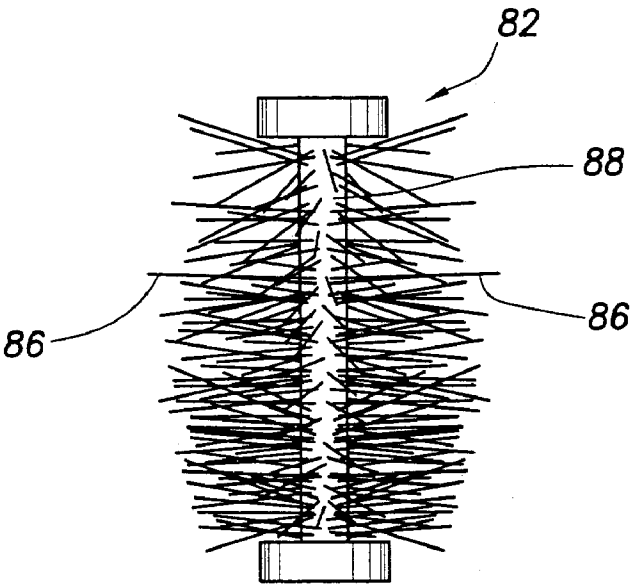
FIG. 10 is a side elevational view of the fifth pressure wave dampener.

In FIG. 10, the dampener 82 is depicted from a side view apart from the wellbore 14. In this view it may be clearly seen that the fibers 86 have a density which increases in the downward direction. It will be readily appreciated that the fibers 86 also have a density which increases in the radially inward direction as well. This varied density aids in impedance matching to the fluid in the well, decreasing the amplitude of pressure waves reflected from the dampener 82.

Figure 11:
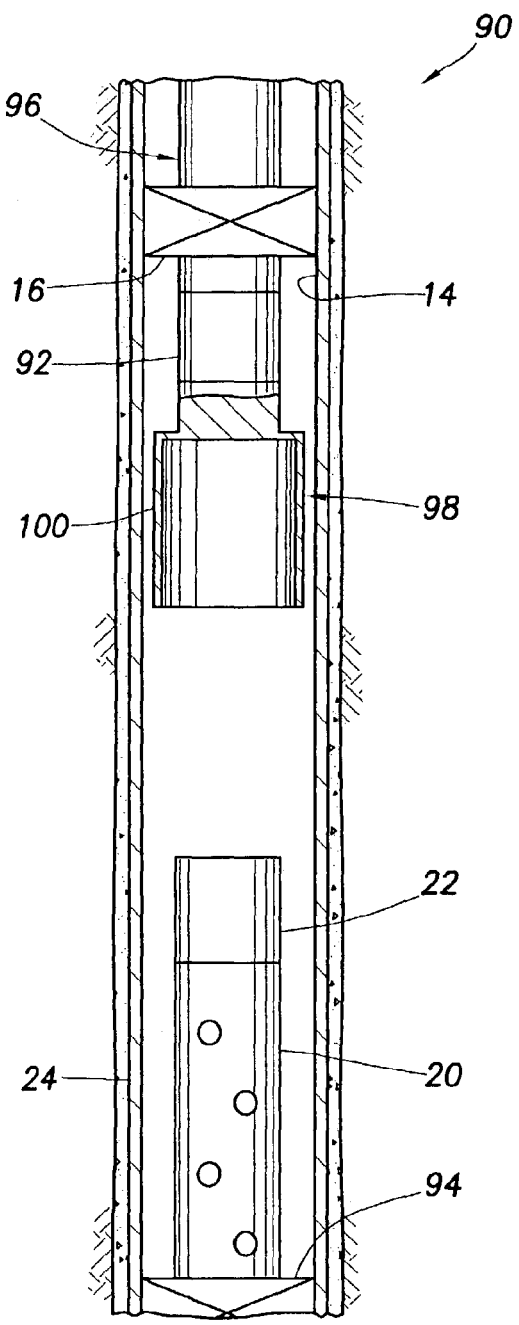
FIG. 11 is a schematic cross-sectional view of a second method embodying principles of the present invention.

Referring additionally now to FIG. 11, another method 90 embodying principles of the invention is representatively illustrated. Elements depicted in FIG. 11 which are similar to elements previously described are indicated in FIG. 11 using the same reference numbers.

In the method 90, the perforating gun 20 is separated from the equipment, such as a well screen 92 and packer 16, for which protection is desired. For example, the perforating gun 20 may be separately conveyed into the wellbore 14 (such as by wireline or tubing conveyance) and anchored therein using a gun hanger 94. Alternatively, the perforating gun 20, hanger 94 and the remainder of a tubing string 96 may be conveyed together into the wellbore 14, the hanger 94 set in the casing 24, the tubing string 96 above the hanger disconnected and raised in the wellbore 14, and the packer 16 set in the casing to anchor the tubing string.

Although the packer 16 and screen 92 are physically separated from the perforating gun 20, they are still subject to damage due to pressure waves generated by detonation of the perforating gun 20. Any of the dampeners 32, 46, 60, 70, 82 described above may be used in the method 90 to dampen these pressure waves. However, the method 90 uses another pressure wave dampener 98.

The dampener 98 is constructed with a relatively thin outer wall or shroud 100 which is intentionally designed to deform when it encounters the pressure waves generated by the perforating gun 20. This deformation of the shroud 100 absorbs energy from the pressure waves. The shroud 100 may deform plastically and/or elastically in response to the pressure waves. It is preferred that the shroud 100 deform plastically in order to absorb a greater amount of energy.

Figure 12:
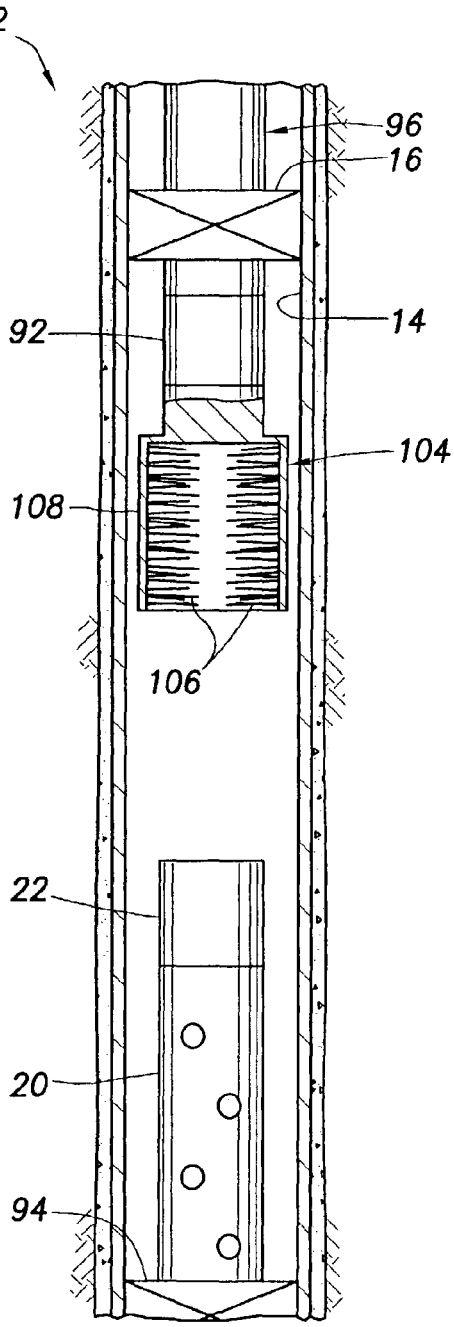
FIG. 12 is a schematic cross-sectional view of a third method embodying principles of the present invention.

Referring additionally now to FIG. 12, another method 102 embodying principles of the invention is representatively illustrated. Elements depicted in FIG. 12 which are similar to elements previously described are indicated in FIG. 12 using the same reference numbers.

The method 102 is substantially similar to the method 90 described above. However, instead of the dampener 98, the method 102 uses a pressure wave dampener 104 which has whiskers or fibers 106 extending inwardly from an outer shroud 108. The fibers 106 may be similar to the fibers 86 described above.

The dampener 104 viscously dampens the pressure waves as they travel through the fibers 106. This reduces the transmission and reflection of the pressure waves in the wellbore 14, thereby protecting the packer 16 and screen 92 from damage due to pressure differentials created by the pressure waves.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, and wherein the dampener is interconnected in a tubular string positioned in the well, a flow passage of the tubular string extending through the dampener.

2. The perforating system according to claim 1, wherein the pressure wave absorbent material is a porous material.

3. The perforating system according to claim 1, wherein the pressure wave absorbent material is a fibrous material.

4. The perforating system according to claim 1, wherein the pressure wave absorbent material is steel wool.

5. The perforating system according to claim 1, wherein the pressure wave absorbent material is mineral wool.

6. The perforating system according to claim 1, wherein the pressure wave absorbent material dampens pressure waves by viscous damping of fluid flowing through the pressure wave absorbent material.

7. The perforating system according to claim 1, further comprising a hollow cavity formed within the pressure wave absorbent material.

8. The perforating system according to claim 7, wherein the pressure wave absorbent material is generally annular shaped, an exterior surface of the pressure wave absorbent material being in contact with fluid in the well exterior to the dampener, and an interior surface of the pressure wave absorbent material being in contact with the cavity.

9. The perforating system according to claim 7, wherein the cavity is substantially filled with liquid.

10. The perforating system according to claim 9, wherein the liquid is well fluid.

11. The perforating system according to claim 9, wherein an impermeable flexible membrane separates the pressure wave absorbent material from the cavity.

12. The perforating system according to claim 1, wherein the flow passage is isolated from the pressure wave absorbent material.

13. The perforating system according to claim 1, wherein the dampener deforms to thereby absorb energy from the pressure waves.

14. The perforating system according to claim 1, further comprising a packer, and wherein the dampener is positioned proximate the packer.

15. The perforating system according to claim 1, wherein the dampener is positioned proximate a top of the perforating gun.

16. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material and a hollow cavity formed within the pressure wave absorbent material, and the hollow cavity having a predetermined size which tunes the system to absorb a desired pressure wave frequency band.

17. A perforating system for a subterranean well, comprising:

a perforating gun positioned in the well; and a fluid pressure wave dampener positioned in the well, the dampener damping pressure waves generated by detonation of the perforating gun, and the dampener including a pressure wave absorbent material, wherein the dampener deforms to thereby absorb energy from the pressure waves, and wherein the dampener is separated from the perforating gun when the perforating gun is detonated.

18. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, wherein the dampener deforms to thereby absorb energy from the pressure waves, and the dampener being separately anchored in the well from the perforating gun when the perforating gun is detonated.

19. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, and the dampener being separated from the perforating gun when the perforating gun is detonated.

20. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, and the dampener being separately anchored in the well from the perforating gun when the perforating gun is detonated.

21. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, and the dampener being interconnected between the perforating gun and a well screen in a tubular string.

22. A perforating system for a subterranean well, comprising:

a perforating gun positioned in the well; and a fluid pressure wave dampener positioned in the well, the dampener damping pressure waves generated by detonation of the perforating gun, the dampener including a pressure wave absorbent material, and the dampener being interconnected between the perforating gun and a packer in a tubular string.

23. A perforating system for a subterranean well, comprising:

a perforating gun positioned in the well; and a fluid pressure wave dampener positioned in the well, the dampener damping pressure waves generated by detonation of the perforating gun, and the dampener being positioned at a location of approximate maximum pressure wave velocity in the well.

24. A perforating system for a subterranean well, comprising:

a perforating gun positioned in the well; and a fluid pressure wave dampener positioned in the well, the dampener damping pressure waves generated by detonation of the perforating gun, and the dampener being tuned to attenuate the pressure waves having a predetermined approximate wavelength.

25. The perforating system according to claim 24, wherein the dampener is positioned approximately one-fourth of the wavelength from a bottom of the well.

26. The perforating system according to claim 24, further comprising a plug set in the well below the perforating gun, and wherein the dampener is positioned approximately one-fourth of the wavelength from the plug.

27. The perforating system according to claim 24, further comprising a packer set in the well above the perforating gun, and wherein the dampener is positioned approximately one-fourth of the wavelength from the packer.

28. A perforating system for a subterranean well, comprising:

a perforating gun positioned in the well; and a fluid pressure wave dampener positioned in the well, the dampener damping pressure waves generated by detonation of the perforating gun, and the dampener being positioned approximately one-fourth of a distance between a top of the perforating gun and a bottom of the well.

29. A perforating system for a subterranean well, comprising:

a perforating gun positioned in the well;

a fluid pressure wave dampener positioned in the well, the dampener damping pressure waves generated by detonation of the perforating gun; and a packer, the dampener being positioned approximately one-fourth of a distance between the packer and a bottom of the well.

30. A perforating system for a subterranean well, comprising:

a perforating gun positioned in the well; and a fluid pressure wave dampener positioned in the well, the dampener damping pressure waves generated by detonation of the perforating gun, and the dampener being positioned from a bottom of the well a distance of approximately one-fourth of a wavelength of the pressure waves generated by detonation of the perforating gun.

* * * * *